US005518822A

United States Patent [19]

Teruuchi et al.

[11] Patent Number: 5,518,822

[45] Date of Patent: May 21, 1996

[54] TITANIUM CARBONITRIDE-BASED CERMET CUTTING INSERT

[75] Inventors: Kiyohiro Teruuchi; Katsuhiko Yano; Niro Odani, all of Tokyo, Japan

[73] Assignee: Mitsubishi Materials Corporation, Tokyo, Japan

[21] Appl. No.: 320,957

[22] Filed: Oct. 12, 1994

[51] Int. Cl.[6] ..... B22F 7/06

[52] U.S. Cl. ..... 428/548; 428/546; 428/547; 428/551; 428/552; 428/569; 428/568

[58] Field of Search ..... 428/546, 548, 428/551, 552, 568, 569, 547; 75/263, 237, 238, 233

[56] References Cited

U.S. PATENT DOCUMENTS

| | | | |
|---|---|---|---|
| 4,935,057 | 6/1990 | Yoshimura et al. | 75/238 |
| 4,942,097 | 7/1990 | Santhanam et al. | 428/552 |
| 5,059,491 | 10/1991 | Odani et al. | 428/614 |
| 5,110,543 | 5/1992 | Odani et al. | 419/29 |
| 5,149,361 | 9/1992 | Iyori et al. | 75/233 |
| 5,149,595 | 9/1992 | Kojo et al. | 428/552 |
| 5,348,806 | 9/1994 | Kojo et al. | 428/552 |
| 5,370,719 | 12/1994 | Teruuchi et al. | 51/309 |

FOREIGN PATENT DOCUMENTS

| | | | |
|---|---|---|---|
| 63-297537 | 4/1989 | Japan | C22C 29/04 |

*Primary Examiner*—Donald P. Walsh
*Assistant Examiner*—John N. Greaves
*Attorney, Agent, or Firm*—Morrison Law Firm

[57] ABSTRACT

A TiCN-based cermet cutting insert superior in toughness with improved wear resistance includes a binding phase and at least two hard dispersion phases. One of the hard dispersion phases includes one of a duplex and triplex structure having a core structure containing at least one of titanium carbonitride and a carbonitride solid solution of Ti and one of a V, Cr, Ti, Nb, Zr, W and Mo (hereinafter referred to as a (Ti,M)CN. The other hard dispersion phase includes a single structure wherein the core structure is composed of at least one of (Ti,M)CN or (Ti,M)CN and TiCN.

5 Claims, No Drawings

TITANIUM CARBONITRIDE-BASED CERMET CUTTING INSERT

BACKGROUND OF THE INVENTION

The present invention is directed to a cutting insert and, more particularly, to a titanium carbonitride-based cermet cutting insert (hereinafter referred to as "TiCN"), which exhibits superior wear resistance and toughness. Such a cutting insert is capable of a long service life and is resistant to damage such as chipping and breaking of the cutting edge while in continuous and discontinuous use.

In recent years, a demand for factory automation has created a need for longer lasting cutting inserts which are tough and wear resistant.

In an attempt to fulfill this demand for superior cutting inserts, Japanese Laid Open Patent Publication No. 50-86512, in conjunction with various technical reports, discloses a TiCN-based cermet which consists essentially of 5 to 30 vol % of a metallic binding phase, which is mainly composed of Co and Ni, together with two hard dispersion phases. One of the two hard dispersion phases has a single-phase structure while the other hard dispersion phase includes a single-phase structure formed of a composite carbonitride solid solution.

The carbonitride solid solution contains Ti and at least one of Ta, Nb, V, Zr, W, Mo and Cr (hereinafter referred to as ("Ti,M)CN").

However, the abovementioned prior art cutting inserts made of TiCN-based cermets have been unable to fulfill the abovementioned demand because of their inability to withstand the demands of continuously cutting steel in an industrial setting. Notwithstanding the toughness of these prior art cutting inserts, such cutting inserts are prone to extensive breakage and chipping of their cutting edges while in continuous use.

OBJECTS AND SUMMARY OF THE INVENTION

Accordingly, it is an object of the present invention to provide a titanium carbonitride-based cermet cutting insert which exhibits superior toughness and improved wear resistance of the cutting edge when compared to prior art TiCN-based cermet cutting inserts.

It is a further object of the present invention to provide a titanium carbonitride-based cermet cutting insert which exhibits improved resistance to cutting and breakage of the cutting edge while in continuous and discontinuous use.

In order to overcome the abovementioned drawback associated with the use of prior art TiCN-based cermet cutting inserts in an industrial setting, the present invention provides a TiCN-based cermet cutting insert which exhibits superior toughness and wear resistance. Additionally, the TiCN-based cermet cutting insert of the present invention increases the life of the cutting insert, and substantially improving its resistance to chipping and breaking of the cutting edge while continuously cutting steel.

Briefly stated, a TiCN-based cermet cutting insert superior in toughness with improved wear resistance includes a binding phase and at least two hard dispersion phases. One of the hard dispersion phases includes one of a duplex and triplex structure having a core structure containing at least one of titanium carbonitride and a carbonitride solid solution of Ti and one of a V, Cr, Ti, Nb, Zr, W and Mo (hereinafter referred to as a (Ti,M)CN.

The other hard dispersion phase is includes a single structure wherein the core structure is composed of at least one of titanium carbonitride and a carbonitride solid solution of Ti and one of a V, Cr, Ti, Nb, Zr, W and Mo or a carbonitride solid solution of Ti and one of a V, Cr, Ti, Nb, Zr, W and Mo (Ti,M)CN).

According to a feature of the present invention, there is provided a cermet cutting insert which includes from about 5 to about 30 volume percent of a metallic binding phase together with a first and second hard dispersion phases. The first hard dispersion phase includes from about 5 to about 40 volume percent of least one of a duplex and a triplex structure having a core of TiCN, while the second hard dispersion phase includes a single structure having a core of a TiCN.

According to another feature of the present invention, there is provided a cermet insert which includes from about 5 to about 30 volume percent of a metallic binding phase together with a first and second hard dispersion phases. The first hard dispersion phase includes from about 5 to about 40 volume percent of at least one of a duplex and a triplex structure having a core of TiCN, while the second hard dispersion phase includes a single structure having a core of a composite carbonitride of a solid solution of Ti and at least one element selected from the group consisting of Ta, Nb, V, Zr, W, Mo and Cr.

According to another feature of the present invention, there is provided a cermet insert which includes from about 5 to about 30 volume percent of a metallic binding phase together with a first and second hard dispersion phases. The first hard dispersion phase includes from about 5 to about 40 volume percent of at least one of a duplex and a triplex structure having a core of TiCN, while the second hard dispersion phase includes a single structure having a core selected from the group consisting of a composite carbonitride of a solid solution of Ti and at least one element selected from the group consisting of Ta, Nb, V, Zr, W, Mo and Cr, and TiCN.

According to another feature of the present invention, there is provided a cermet insert which includes from about 5 to about 30 volume percent of a metallic binding phase together with a first and second hard dispersion phases. The first hard dispersion phase includes from about 5 to about 40 volume percent of at least one of a duplex and a triplex structure having a core of a composite carbonitride of a solid solution of Ti and at least one element selected from the group consisting of Ta, Nb, V, Zr, W, Mo and Cr, while the second hard dispersion phase includes a single structure having a core selected from the group consisting of a composite carbonitride of a solid solution of Ti and at least one element selected from the group consisting of Ta, Nb, V, Zr, W, Mo and Cr, and TiCN.

According to another feature of the present invention, there is provided a cermet cutting insert which includes from about 5 to about 30 volume percent of a metallic binding phase together with a first and second hard dispersion phases. The first hard dispersion phase includes from about 5 to about 40 volume percent of at least one of a duplex and a triplex structure having a core of a composite carbonitride of a solid solution of Ti and at least one element selected from the group consisting of Ta, Nb, V, Zr, W, Mo and Cr, while the second hard dispersion phase includes a single structure having a core of a composite carbonitride of a solid solution of Ti and at least one element selected from the group consisting of Ta, Nb, V, Zr, W, Mo and Cr.

The above, and other objects, features and advantages of the present invention will become apparent from the following description.

DETAILED DESCRIPTION OF THE PREFERRED EMBODIMENTS

The inventors have discovered that a TiCN based cermet cutting insert exhibits superior toughness and wear resistance when the TiCN-based cermet cutting insert includes 5 to 40 vol % of at least a first hard dispersion phase including one of a duplex and a triplex phase structure. The first hard dispersion phase structure has a core structure composed of at least one of a titanium carbonitride (TiCN) and (Ti,M)CN, with the balance being a second hard dispersion phase and a metallic binding phase. The combination of the first and second hard dispersion phases together with the metallic binding phase substantially improves the wear resistance and toughness of a TiCN-based cermet cutting insert.

The present invention provides a wear resistant cutting insert made of a TiCN-based cermet which is composed of two coexisting hard dispersion phases in combination with a metallic binding phase. One of the two hard dispersion phases includes at least one of a duplex and triplex structure characterized by a core structure composed of at least one of titanium carbonitride (hereinafter referred to as TiCN hard dispersion phase) and a carbonitride solid solution of Ti and one of a V, Cr, Ti, Nb, Zr, W and Mo (hereinafter referred to as a (Ti,M)CN hard dispersion phase).

The other hard dispersion phase is a single structure with a core structure composed of at least one of (Ti,M)CN or (Ti,M)CN and TiCN.

The TiCN hard dispersion phase imparts superior wear resistant properties to the cutting insert, while the (Ti,M)CN hard dispersion phase in combination with the binding phase substantially improves the toughness of the cutting insert.

The binding phase is composed of at least one of Co and Ni. The combination of the first and second hard dispersion phases with the binding phase provide for a long lasting cutting insert with superior toughness which is substantially resistant to breaking and/or chipping of the cutting edge when used continuously and discontinuously.

The wear resistant TiCN-based cermet cutting insert includes 5 to 30 vol % of a binding phase, with the balance including two hard dispersion phases. The binding phase imparts toughness to the cutting insert. When the content of the binding phase is below 5 vol %, superior toughness is not achieved. When the binding phase content exceeds 30 vol %, the wear resistance is reduced.

The content of the hard dispersion phase includes one of a duplex and a triplex phase structure having a core structure composed of at least one of a titanium carbonitride (TiCN) and (Ti,M)CN. The hard dispersion phase is from about 5 vol % to 40 vol % of the cermet material.

The cutting insert exhibits degraded wear resistance and strength when the hard dispersion phase is present in an amount less the 5 vol %. On the other hand, a content of more than 40 vol % of the hard dispersion phase exhibits reduced wear resistance of the cutting insert.

When the hard dispersion phase is less than 30 vol %, the toughness of the cutting insert is degraded.

This invention is illustrated in more detail by reference to the examples described hereinafter.

EXAMPLE 1

Material powders with varying compositions, as shown in Table 1 were prepared. Each of the various material powders contained numerous particles having a mean particle size ranging from about 0.5 to about 2 μm. The various material powders are exemplified by the following compositions:

(Ti,W)CN, wherein the weight ratio of TiCN to WC was 70/30;

(Ti,Ta)CN, wherein the weight ratio of TiCN to TaC was 70/30;

(Ti,Nb)CN, wherein the weight ratio of TiCN to NbC was 70/30;

(Ti,Zr)CN, wherein the weight ratio of TiCN to ZrC was 80/20;

(Ti,W,Mo)CN, wherein the weight ratio of TiCN/WC/Mo2C was 60:30:10 respectively;

(Ti,W.Ta)CN, wherein the weight ratio of TiCN/WC/TaC was 60:20:20 respectively;

(Ti,Ta,Nb)CN, wherein the weight ratio of TiCN/TaC/NbC was 60:20:20 respectively;

(Ti,Ta,Mo)CN, wherein the weight ratio of TiCN/TaC/$Mo_2C$ was 60:20:20 respectively;

(W,Mo)C, wherein the weight ratio of WC to $Mo_2C$ was 50/50; and (W,Mo,Ta,Nb,Zr)CN wherein the weight ratio of WC/$Mo_2C$/TaCN/NbCN/ZrCN was 20:20:20:20:20 respectively, as well as powders of TiCN, Co and Ni.

Each of the compositions of Table 1 were compressed into green bodies, by being wet blended by a ball mill over a 72-hour period. After drying, the blended compositions were compression formed under a pressure of 1.5 ton/$cm^2$ to provide compressed green bodies.

The thus obtained, compacted green bodies were then sintered under either one of the following sintering condition:

NITROGEN ATMOSPHERE SINTERING

In this procedure, the compacted green bodies were heating from room temperature to 1100° C in a nitrogen atmosphere of 0.05 to about 0.1 torr. The nitrogen atmosphere was increased to, and maintained at 40 to 300 torr for a period of time sufficient to heat the compacted green body from 1100° C to a sintering temperature of from 1420 to about 1600° C.

The heated green bodies were maintained at the sintering temperature for a period of one hour and then cooled down to room temperature.

VACUUM SINTERING

In this procedure, the compacted green bodies were maintained for one hour at a temperature ranging between 1420 and 1500° C in a vacuum of 0.05 to 0.1 torr, followed by cooling.

After the sintering step, sample Nos. 1 to 13, were obtained, each having throw-away tips which were in compliance with SNMG 120403. Samples 1 - 13 represented TiCN based cermet cutting inserts while sample Nos. 1 to 6, represented prior art TiCN-based cermet cutting inserts (hereinafter referred to as "conventional cutting inserts"). The conventional cutting inserts were contained a single hard dispersion phase composed of one of (Ti,M)CN and TiCN.

In order to measure the metallic composition of the cores of the respective hard dispersion phases, the structures of the abovementioned samples were examined by means of a transmission electron microscope and annexed dispersive x-ray spectroscopy (EDX).

Simultaneously, an image analyzer was utilized to determine the ratio of the binding phase to the hard dispersion phase, as well as the proportion of each of the phases constituting the hard dispersion phase. These samples were simultaneously subjected to a discontinuous cutting test and a continuous cutting test which are described as follows:

Continuous cutting test included the following:

Cut material: Round bar of steel SNCM 439 (hardness: HB 270)

Cutting speed: 200 m/min

Penetration: 2.5 mm

Feed: 0.3 mm/rev

Cutting time: 5 minutes

Discontinuous cutting test included the following:

Cut material: Round bar of a steel SNCM 439 (hardness: HB 270) having three longitudinal grooves, which were cut at three points equally spaced in a longitudinal direction.

Cutting speed: 180 m/min

Penetration: 2 mm

Feed: 0.3 mm/rev

Cutting time: 20 minutes.

The width of wear on the relief surface on each sample was measured after completion of each of the abovementioned tests. The results including the proportions of the binding phase and the hard dispersion phases are reported in Tables 2. The results pertaining to the analysis of the binding phase and the hard dispersion phases are reported in Tables 2 –7.

TABLE 1

| TYPE | | COMPOSITION (WT %) Co | Ni | CARBIDE, NITRIDE, CARBO-NITRIDE | (Ti, M)CN | TiCN | SINTERING CONDITION |
|---|---|---|---|---|---|---|---|
| CUTTING INSERT OF THE INVENTION | 1 | 8 | 7 | WC: 5, TaCN: 5, $Cr_3C_2$: 1 | (Ti, Zr)CN: Bal. | 25 | NITROGEN ATMOSPHERE |
| | 2 | 8 | 7 | WC: 10, TaC: 5 | (Ti, Nb)CN: Bal. | 15 | |
| | 3 | 7 | 8 | (W, Mo)C: 5, TaCN: 5 | (Ti, Ta, Nb)CN: Bal. | 30 | |
| | 4 | 15 | 5 | (W, Mo)C: 5 | (Ti, W, Mo)CN: 25, (Ti, Ta)CN: Bal. | — | |
| | 5 | 8 | 7 | WC: 5, VC: 5 | (Ti, W, Mo)CN: 25, (Ti, Zr)CN: Bal. | — | |
| | 6 | 5 | 10 | $Mo_2C$: 5, ZrC: 5 | (Ti, W)CN: 20, (Ti, Ta)CN: Bal. | — | |
| | 7 | — | 10 | WC: 10 | (Ti, Zr)CN: 20, (Ti, Ta, Mo)CN: Bal. | — | |
| | 8 | 10 | 20 | $Mo_2C$: 5 | (Ti, Ta, Nb)CN: 25 | Bal. | |
| | 9 | 10 | 5 | WC: 5, NbC: 5 | (Ti, Ta)CN: 30 | Bal. | |
| | 10 | 8 | 7 | TiN: 10, WC: 10, NbC: 10, VC: 5 | (Ti, Nb)CN: 20 | Bal. | |
| | 11 | 10 | 5 | TiN: 10, WC: 10, $Mo_2C$: 5, NbC: 15 | (Ti, V)CN: 15 | Bal. | |
| | 12 | 8 | — | NbCN: 10 | (Ti, Zr)CN: 30, (Ti, W, Ta)CN: Bal. | 22 | |
| | 13 | 8 | 7 | WC: 5, $Mo_2C$: 5, NbC: 20 | (Ti, W)CN: 5, (Ti, V)CN: 15 | Bal. | |
| CONVENTIONAL CUTTING INSERT | 1 | — | 25 | WC: 5 | — | Bal. | VACUUM |
| | 2 | 15 | 15 | (W, Mo)C: 5 | — | Bal. | |
| | 3 | — | 10 | WC: 10 | (Ti, Zr)CN: 20, (Ti, Ta, Mo)CN: Bal. | — | |
| | 4 | 15 | 5 | (W, Mo)C: 5 | (Ti, W, Mo)CN: 25, (Ti, Ta)CN: Bal. | — | |
| | 5 | 10 | 20 | $Mo_2C$: 5 | (Ti, Ta, Nb)CN: 25 | Bal. | |
| | 6 | 18 | 10 | (W, Mo)C: 5 | (Ti, Ta, Nb)CN: Bal. | 32 | |

TABLE 2

| TYPE | | PROPORTION OF BINDING PHASE (VOL %) | PROPORTION TO HARD DISPERSION PHASE (VOL %) CORE TiCN DUPLEX | TRIGLE | SINPLEX | CORE (Ti, M)CN DUPLEX | TRIGLE | SINGLE OF TiN | FINE SINGLE PHASE COMPOSED CUTTING | WIDTH OF WEAR OF RELIEF SURFASE (mm) CONTINUOUS CUTTING | DISCONTINUOUS |
|---|---|---|---|---|---|---|---|---|---|---|---|
| CUTTING INSERT OF THE INVENTION | 1 | 12 | — | 34 | — | — | — | Bal. | — | 0.16 | 0.29 |
| | 2 | 12 | — | 38 | — | — | — | Bal. | — | 0.15 | 0.30 |
| | 3 | 14 | 11 | 21 | — | — | — | Bal. | — | 0.13 | 0.29 |
| | 4 | 21 | — | — | — | — | 22 | Bal. | — | 0.16 | 0.29 |
| | 5 | 12 | — | — | — | — | 38 | Bal. | — | 0.17 | 0.27 |
| | 6 | 12 | — | — | — | 8 | 27 | Bal. | — | 0.18 | 0.29 |
| | 7 | 10 | — | — | — | 25 | 6 | Bal | — | 0.16 | 0.30 |
| | 8 | 28 | 15 | — | 35 | — | — | Bal. | — | 0.18 | 0.33 |
| | 9 | 13 | — | 37 | 25 | — | — | Bal. | — | 0.16 | 0.31 |
| | 10 | 12 | 6 | 18 | 27 | — | — | Bal. | 6 | 0.14 | 0.31 |
| | 11 | 12 | — | — | 21 | — | Bal. | 24 | 7 | 0.16 | 0.28 |
| | 12 | 7 | — | — | 31 | 4 | 16 | Bal. | — | 0.17 | 0.30 |
| | 13 | 12 | — | — | Bal. | 5 | 32 | 14 | — | 0.17 | 0.33 |
| CONVENTIONAL CUTTING INSERT | 1 | 25 | — | — | Bal. | — | — | — | — | 0.14 | BROKEN IN 2 MIN. |
| | 2 | 27 | — | — | Bal. | — | — | — | — | 0.13 | BROKEN IN 5 MIN. |
| | 3 | 12 | — | — | — | — | — | Bal. | — | 0.16 | BROKEN IN 7 MIN. |

TABLE 2-continued

| TYPE | PROPORTION OF BINDING PHASE (VOL %) | PROPORTION TO HARD DISPERSION PHASE (VOL %) CORE TiCN DU-PLEX | CORE TiCN TRI-GLE | CORE TiCN SIN-PLEX | CORE (Ti, M)CN DU-PLEX | CORE (Ti, M)CN TRI-GLE | CORE (Ti, M)CN SIN-OF TiN | FINE SINGLE PHASE COMPOSED CUTTING | WIDTH OF WEAR OF RELIEF SURFASE (mm) CON-TINUOUS CUTTING | DISCON-TINUOUS |
|---|---|---|---|---|---|---|---|---|---|---|
| 4 | 22 | — | — | — | — | — | Bal. | — | 0.15 | CHIPPED IN 7 MIN. |
| 5 | 29 | — | — | 20 | — | — | Bal. | — | 0.17 | CHIPPED IN 5 MIN. |
| 6 | 25 | — | — | 29 | — | — | Bal. | — | 0.17 | CHIPPED IN 3 MIN. |

TABLE 3

| TYPE | | COMPOSITION OF DUPLEX HARD DISPERSION PHASE HAVING A CORE TiCN (WT %) CORE Ti | Ta | Nb | V | Zr | W | Mo | Cr | SURROUNDING STRUCTURE Ti | Ta | Nb | V | Zr | W | Mo | Cr |
|---|---|---|---|---|---|---|---|---|---|---|---|---|---|---|---|---|---|
| CUTTING INSERT OF THE INVENTION | 1 | — | — | — | — | — | — | — | — | — | — | — | — | — | — | — | — |
| | 2 | — | — | — | — | — | — | — | — | — | — | — | — | — | — | — | — |
| | 3 | 100.0 | 0.0 | 0.0 | — | — | 0.0 | 0.0 | — | 67.6 | 16.0 | 0.4 | — | — | 8.3 | 7.7 | — |
| | 4 | — | — | — | — | — | — | — | — | — | — | — | — | — | — | — | — |
| | 5 | — | — | — | — | — | — | — | — | — | — | — | — | — | — | — | — |
| | 6 | — | — | — | — | — | — | — | — | — | — | — | — | — | — | — | — |
| | 7 | — | — | — | — | — | — | — | — | — | — | — | — | — | — | — | — |
| | 8 | 99.6 | 0.0 | 0.0 | — | — | — | 0.4 | — | 52.4 | 0.6 | 10.2 | — | — | — | 36.8 | — |
| | 9 | — | — | — | — | — | — | — | — | — | — | — | — | — | — | — | — |
| | 10 | 99.3 | — | 0.4 | 0.0 | — | 0.3 | — | — | 52.8 | — | 23.7 | 10.9 | — | 12.6 | — | — |
| | 11 | — | — | — | — | — | — | — | — | — | — | — | — | — | — | — | — |
| | 12 | — | — | — | — | — | — | — | — | — | — | — | — | — | — | — | — |
| | 13 | — | — | — | — | — | — | — | — | — | — | — | — | — | — | — | — |

TABLE 4

| TYPE | Ti | Ta | Nb | V | Zr | W | Mo | Cr |
|---|---|---|---|---|---|---|---|---|
| CUTTING INSERT OF THE INVENTION | COMPOSITION OF TRIPLEX HARD DISPERSION PHASE HAVING A CORE TiCN (WT %) CORE | | | | | | | |
| 1 | 99.7 | 0.0 | — | — | 0.0 | 0.3 | — | 0.0 |
| 2 | 99.5 | 0.3 | 0.0 | — | — | 0.2 | — | — |
| 3 | 100.0 | 0.0 | 0.0 | — | — | 0.0 | 0.0 | — |
| 4 | — | — | — | — | — | — | — | — |
| 5 | — | — | — | — | — | — | — | — |
| 6 | — | — | — | — | — | — | — | — |
| 7 | — | — | — | — | — | — | — | — |
| 8 | — | — | — | — | — | — | — | — |
| 9 | 99.4 | 0.0 | 0.0 | — | — | 0.6 | — | — |
| 10 | 99.5 | — | 0.0 | 0.0 | — | 0.5 | — | — |
| 11 | — | — | — | — | — | — | — | — |
| 12 | — | — | — | — | — | — | — | — |
| 13 | — | — | — | — | — | — | — | — |
| CUTTING INSERT OF THE INVENTION | INTERMEDIATE LAYER | | | | | | | |
| 1 | 44.6 | 26.1 | — | — | 1.6 | 27.0 | — | 0.7 |

TABLE 4-continued

| TYPE | Ti | Ta | Nb | V | Zr | W | Mo | Cr |
|---|---|---|---|---|---|---|---|---|
| 2 | 25.0 | 34.9 | 5.0 | — | — | 35.1 | — | — |
| 3 | 41.1 | 19.4 | 0.7 | — | — | 19.3 | 19.5 | — |
| 4 | — | — | — | — | — | — | — | — |
| 5 | — | — | — | — | — | — | — | — |
| 6 | — | — | — | — | — | — | — | — |
| 7 | — | — | — | — | — | — | — | — |
| 8 | — | — | — | — | — | — | — | — |
| 9 | 39.6 | 11.8 | 9.3 | — | — | 39.3 | — | — |
| 10 | 24.0 | — | 27.0 | 6.1 | — | 42.9 | — | — |
| 11 | — | — | — | — | — | — | — | — |
| 12 | — | — | — | — | — | — | — | — |
| 13 | — | — | — | — | — | — | — | — |
| CUTTING INSERT OF THE INVENTION | SURROUNDING STRUCTURE | | | | | | | |
| 1 | 62.7 | 17.2 | — | — | 2.9 | 16.0 | — | 1.2 |
| 2 | 45.0 | 15.6 | 13.3 | — | — | 26.1 | — | — |
| 3 | 59.0 | 17.6 | 0.0 | — | — | 12.1 | 11.3 | — |
| 4 | — | — | — | — | — | — | — | — |
| 5 | — | — | — | — | — | — | — | — |
| 6 | — | — | — | — | — | — | — | — |
| 7 | — | — | — | — | — | — | — | — |

TABLE 4-continued

| COMPOSITION OF TRIPLEX HARD DISPERSION PHASE HAVING A CORE TiCN (WT %) | | | | | | | | |
|---|---|---|---|---|---|---|---|---|
| TYPE | Ti | Ta | Nb | V | Zr | W | Mo | Cr |
| 8 | — | — | — | — | — | — | — | — |
| 9 | 62.4 | 4.2 | 19.5 | — | — | 13.9 | — | — |
| 10 | 46.2 | — | 25.4 | 13.7 | — | 14.7 | — | — |
| 11 | — | — | — | — | — | — | — | — |
| 12 | — | — | — | — | — | — | — | — |
| 13 | — | — | — | — | — | — | — | — |

TABLE 6-continued

| COMPOSITION OF TRIPLEX HARD DISPERSION PHASE HAVING A CORE (Ti, M)CN (WT %) | | | | | | | | |
|---|---|---|---|---|---|---|---|---|
| TYPE | Ti | Ta | Nb | V | Zr | W | Mo | Cr |
| 8 | — | — | — | — | — | — | — | — |
| 9 | — | — | — | — | — | — | — | — |
| 10 | — | — | — | — | — | — | — | — |
| 11 | 29.8 | — | 14.4 | 2.6 | — | 45.5 | 7.7 | — |
| 12 | 27.2 | 11.8 | 51.1 | — | 0.0 | 9.9 | — | — |
| 13 | 29.2 | — | 23.5 | 0.0 | — | 33.4 | 13.9 | — |

TABLE 5

| | | COMPOSITION OF DUPLEX HARD DISPERSION PHASE HAVING A CORE (Ti, M)CN (WT %) | | | | | | | | | | | | | | | |
|---|---|---|---|---|---|---|---|---|---|---|---|---|---|---|---|---|---|
| | | CORE | | | | | | | | SURROUNDING STRUCTURE | | | | | | | |
| TYPE | | Ti | Ta | Nb | V | Zr | W | Mo | Cr | Ti | Ta | Nb | V | Zr | W | Mo | Cr |
| CUTTING INSERT OF THE INVENTION | 1 | — | — | — | — | — | — | — | — | — | — | — | — | — | — | — | — |
| | 2 | — | — | — | — | — | — | — | — | — | — | — | — | — | — | — | — |
| | 3 | — | — | — | — | — | — | — | — | — | — | — | — | — | — | — | — |
| | 4 | — | — | — | — | — | — | — | — | — | — | — | — | — | — | — | — |
| | 5 | — | — | — | — | — | — | — | — | — | — | — | — | — | — | — | — |
| | 6 | 56.3 | 17.7 | — | — | 0.7 | 14.9 | 10.4 | — | 39.9 | 19.1 | — | — | 17.4 | 9.3 | 14.3 | — |
| | 7 | 27.4 | 8.4 | — | — | 1.3 | 54.5 | 8.4 | — | 58.8 | 2.2 | — | — | 15.0 | 21.9 | 2.1 | — |
| | 8 | — | — | — | — | — | — | — | — | — | — | — | — | — | — | — | — |
| | 9 | — | — | — | — | — | — | — | — | — | — | — | — | — | — | — | — |
| | 10 | — | — | — | — | — | — | — | — | — | — | — | — | — | — | — | — |
| | 11 | — | — | — | — | — | — | — | — | — | — | — | — | — | — | — | — |
| | 12 | 34.1 | 11.2 | 41.1 | — | 0.5 | 13.1 | — | — | 50.1 | 21.4 | 5.8 | — | 0.4 | 22.3 | — | — |
| | 13 | 20.7 | — | 33.3 | 0.0 | — | 28.3 | 17.7 | — | 43.9 | — | 29.0 | 1.9 | — | 14.6 | 10.6 | — |

TABLE 6

| COMPOSITION OF TRIPLEX HARD DISPERSION PHASE HAVING A CORE (Ti, M)CN (WT %) | | | | | | | | |
|---|---|---|---|---|---|---|---|---|
| TYPE | Ti | Ta | Nb | V | Zr | W | Mo | Cr |
| CUTTING INSERT OF THE INVENTION | CORE | | | | | | | |
| 1 | — | — | — | — | — | — | — | — |
| 2 | — | — | — | — | — | — | — | — |
| 3 | — | — | — | — | — | — | — | — |
| 4 | 56.2 | 26.4 | — | — | — | 11.0 | 6.4 | — |
| 5 | 52.3 | — | — | 10.6 | 4.7 | 26.2 | 6.2 | — |
| 6 | 68.4 | 30.7 | — | — | 0.0 | 0.5 | 0.4 | — |
| 7 | 58.7 | 22.1 | — | — | 0.0 | 0.7 | 18.5 | — |
| 8 | — | — | — | — | — | — | — | — |
| 9 | — | — | — | — | — | — | — | — |
| 10 | — | — | — | — | — | — | — | — |
| 11 | 79.9 | — | 0.6 | 18.6 | — | 0.4 | 0.5 | — |
| 12 | 58.2 | 22.1 | 1.8 | — | 0.0 | 17.9 | — | — |
| 13 | 77.0 | — | 0.0 | 0.0 | — | 22.6 | 0.4 | — |
| CUTTING INSERT OF THE INVENTION | INTERMEDIATE LAYER | | | | | | | |
| 1 | — | — | — | — | — | — | — | — |
| 2 | — | — | — | — | — | — | — | — |
| 3 | — | — | — | — | — | — | — | — |
| 4 | 24.6 | 12.5 | — | — | — | 32.4 | 30.5 | — |
| 5 | 38.4 | — | — | 9.4 | 2.7 | 41.6 | 7.9 | — |
| 6 | 31.3 | 3.2 | — | — | 10.0 | 12.8 | 42.7 | — |
| 7 | 24.6 | 4.2 | — | — | 4.0 | 63.0 | 4.2 | — |

TABLE 6-continued

| COMPOSITION OF TRIPLEX HARD DISPERSION PHASE HAVING A CORE (Ti, M)CN (WT %) | | | | | | | | |
|---|---|---|---|---|---|---|---|---|
| TYPE | Ti | Ta | Nb | V | Zr | W | Mo | Cr |
| CUTTING INSERT OF THE INVENTION | SURROUNDING STRUCTURE | | | | | | | |
| 1 | — | — | — | — | — | — | — | — |
| 2 | — | — | — | — | — | — | — | — |
| 3 | — | — | — | — | — | — | — | — |
| 4 | 61.2 | 31.3 | — | — | — | 4.2 | 3.3 | — |
| 5 | 51.5 | — | — | 13.2 | 8.7 | 21.4 | 5.2 | — |
| 6 | 43.7 | 10.8 | — | — | 17.4 | 19.6 | 8.5 | — |
| 7 | 61.8 | 0.8 | — | — | 16.8 | 19.8 | 0.8 | — |
| 8 | — | — | — | — | — | — | — | — |
| 9 | — | — | — | — | — | — | — | — |
| 10 | — | — | — | — | — | — | — | — |
| 11 | 49.4 | — | 26.4 | 4.3 | — | 11.2 | 8.7 | — |
| 12 | 48.1 | 10.7 | 29.1 | — | 0.5 | 11.6 | — | — |
| 13 | 44.7 | — | 28.4 | 1.3 | — | 12.3 | 13.3 | — |

TABLE 7

| TYPE | | COMPOSITION OF SINGLE HARD DISPERSION PHASE (WT %) | | | | | | | | | | | | | | | |
|---|---|---|---|---|---|---|---|---|---|---|---|---|---|---|---|---|---|
| | | TiCN | | | | | | | | (Ti, M)CN | | | | | | | |
| | | Ti | Ta | Nb | V | Zr | W | Mo | Cr | Ti | Ta | Nb | V | Zr | W | Mo | Cr |
| CUTTING INSERT OF THE INVENTION | 1 | — | — | — | — | — | — | — | — | 86.3 | 0.0 | — | — | 12.6 | 1.1 | — | 0.0 |
| | 2 | — | — | — | — | — | — | — | — | 69.4 | 0.4 | 29.5 | — | — | 0.7 | — | — |
| | 3 | — | — | — | — | — | — | — | — | 57.6 | 21.3 | 20.1 | — | — | 0.6 | 0.4 | — |
| | 4 | — | — | — | — | — | — | — | — | 72.4 | 27.6 | — | — | — | 0.0 | 0.0 | — |
| | 5 | — | — | — | — | — | — | — | — | 93.1 | — | — | 0.0 | 6.2 | 0.7 | 0.0 | — |
| | 6 | — | — | — | — | — | — | — | — | 64.8 | 34.3 | — | — | 0.0 | 0.5 | 0.4 | — |
| | 7 | — | — | — | — | — | — | — | — | 61.7 | 20.3 | — | — | 0.0 | 0.5 | 17.5 | — |
| | 8 | 99.2 | 0.0 | 0.0 | — | — | — | 0.8 | — | 60.8 | 19.5 | 19.0 | — | — | — | 0.7 | — |
| | 9 | 99.2 | 0.8 | 0.0 | — | — | 0.0 | — | — | 71.5 | 28.5 | 0.0 | — | — | 0.0 | — | — |
| | 10 | 100.0 | — | 0.0 | 0.0 | — | 0.0 | — | — | 77.3 | — | 21.8 | 0.5 | — | 0.4 | — | — |
| | 11 | 99.4 | — | 0.6 | 0.0 | — | 0.0 | 0.0 | — | 45.5 | — | 34.9 | 1.6 | — | 9.3 | 8.7 | — |
| | 12 | 100.0 | 0.0 | 0.0 | — | 0.0 | 0.0 | — | — | 82.1 | 0.0 | 0.4 | — | 17.5 | 0.0 | — | — |
| | 13 | 98.9 | — | 0.0 | 0.0 | — | 0.6 | 0.5 | — | 82.5 | — | 0.0 | 16.7 | — | 0.5 | 0.3 | — |
| CONVENTIONAL CUTTING INSERT | 1 | 98.9 | — | — | — | — | 1.1 | — | — | — | — | — | — | — | — | — | — |
| | 2 | 98.8 | — | — | — | — | 0.7 | 0.5 | — | — | — | — | — | — | — | — | — |
| | 3 | — | — | — | — | — | — | — | — | 57.9 | 14.7 | — | — | 4.6 | 11.3 | 11.5 | — |
| | 4 | — | — | — | — | — | — | — | — | 55.2 | 23.4 | — | — | — | 13.9 | 7.5 | — |
| | 5 | 99.5 | 0.0 | 0.0 | — | — | — | 0.5 | — | 62.4 | 11.9 | 13.3 | — | — | — | 12.4 | — |
| | 6 | 99.3 | 0.0 | 0.0 | — | — | 0.7 | 0.0 | — | 64.5 | 15.3 | 15.2 | — | — | 2.4 | 2.6 | — |

Sample Nos. 1–13 represent cutting inserts of the present invention, wherein the TiCN based cermet cutting inserts are characterized by a binding phase and two coexisting hard dispersion phases. One of the two hard dispersion phases includes one of a duplex and a triplex structure in which the core is composed of at least one of TiCN and (Ti,M)CN. The remaining hard dispersion phase includes a single structure having a core structure composed of one of (Ti,M)CN or (Ti,M)CN and TiCN.

It is clear from Tables 3–7 that samples 1–13 did not undergo any damage, such as breakage or chipping of the cutting edge. These results show that TiCN-based cermet cutting inserts of the present invention are superior in toughness when compared to conventional samples 1–6, which are characterized by a single hard dispersion phase composed of (Ti,M)CN and/or TiCN. The conventional cutting inserts could not be used discontinuously, due to breakage and chipping of the cutting edge. These drawbacks can be traced to the underlying weakness of the conventional cutting inserts.

Additionally, samples 1–13 exhibited excellent wear resistant during continuous cutting, when compared to conventional samples 1–6, which exhibited poorer wear resistance.

As has been described, the TiCN-based cermet cutting insert of the present invention excels both in wear resistance and toughness. It exhibits improved resistance to wear and tear damage such as breakage and/or chipping of the cutting edge when in continuous and discontinuous use. These features, in turn, impart excellent cutting properties to the cutting insert and substantially increase its life expectancy.

Having described preferred embodiments of the present invention, it is to be understood that the invention is not limited to those precise embodiments, and that various changes and modifications may be effected by one skilled in the art without departing from the scope or spirit of the invention as defined in the appended claims.

What is claimed:

1. A cerment cutting insert comprising: from about 5 to about 30 volume percent of a metallic binding phase; consisting of at least one of Ni and Co; from about 5 to about 40 volume percent of a first hard dispersion phase having at least one of a duplex and a triplex structure comprising a core of TiCN; and a balance of said cutting insert being a second hard dispersion phase having a single-phase structure having a core of a TiCN.

2. A cermet cutting insert comprising: from about 5 to about 30 volume percent of a metallic binding phase consisting of at least one of Ni and Co; from 5 to 40 volume percent of a first hard dispersion phase having at least one of a duplex and a triplex structure comprising a core of TiCN; and a balance of said cutting insert being a second hard dispersion phase having a core of a composite carbonitride of a solid solution of Ti and at least one element selected from the group consisting of Ta, Nb, V, Zr, W, Mo and Cr.

3. A cermet cutting insert comprising:

from about 5 to about 30 volume percent of a metallic binding phase consisting of at least one of Ni and Co from 5 to 40 volume percent of a first hard dispersion phase having at least one of a duplex and a triplex structure having a core of a composite carbonitride of a solid solution of Ti and at least one element selected from the group consisting of Ta, Nb, V, Zr, W, Mo and Cr; and a balance of said cutting insert being a second hard dispersion phase having a single-phase structure having a core of a composite carbonitride of a solid solution of Ti and at least one element selected from the group consisting of Ta, Nb, V, Zr, W, Mo and Cr.

4. A cermet cutting insert comprising: from about 5 to about 30 volume percent of a metallic binding phase consisting of at least one of Ni and Co;

from 5 to 40 volume percent of a first hard dispersion phase having at least one of a duplex and a triplex structure having a core of a composite carbonitride of a solid solution of Ti and at least one element selected from the group consisting of Ta, Nb, V, Zr, W, Mo and Cr; and a balance of said cutting insert being a second hard dispersion phase having a single-phase structure having a core selected from the group consisting of a composite carbonitride of a solid solution of Ti and at least one element selected from the group consisting of Ta, Nb, V, Zr, W, Mo, Cr and TiCN.

5. A cermet cutting insert comprising:

from about 5 to about 30 volume percent of a metallic binding phase consisting of at least one of Ni and Co;

from 5 to 40 volume percent of a first hard dispersion phase having a core of TiCN; a triplex structure having a core of a composite carbonitride of a solid a balance of said cutting insert being a second hard dispersion phase having a single-phase structure having a core selected from the group consisting of a composite carbonitride of a solid solution of Ti and at least one element selected from the group consisting of Ta, Nb, V, Zr, W, Mo, Cr and TiCN.

* * * * *